US010752485B2

(12) United States Patent
Park

(10) Patent No.: US 10,752,485 B2
(45) Date of Patent: Aug. 25, 2020

(54) CLEANING MODULE-INTEGRATED BEVERAGE DISPENSING HEAD

(71) Applicant: INTELLECTUAL DISCOVERY CO., LTD., Seoul (KR)

(72) Inventor: Jong-ha Park, Seoul (KR)

(73) Assignee: INTELLECTUAL DISCOVERY CO., LTD., Seoul (KR)

( * ) Notice: Subject to any disclaimer, the term of this patent is extended or adjusted under 35 U.S.C. 154(b) by 0 days.

(21) Appl. No.: 15/779,245

(22) PCT Filed: Nov. 25, 2016

(86) PCT No.: PCT/KR2016/013675
§ 371 (c)(1),
(2) Date: Aug. 3, 2018

(87) PCT Pub. No.: WO2017/091025
PCT Pub. Date: Jun. 1, 2017

(65) Prior Publication Data

US 2018/0362319 A1 Dec. 20, 2018

(30) Foreign Application Priority Data

Nov. 25, 2015 (KR) ..... 10-2015-0165424

(51) Int. Cl.
*B67D 1/07* (2006.01)
*B67D 1/08* (2006.01)
*B08B 9/032* (2006.01)

(52) U.S. Cl.
CPC ..... *B67D 1/07* (2013.01); *B08B 9/032* (2013.01); *B08B 9/0326* (2013.01); *B67D 1/08* (2013.01); *B08B 9/0325* (2013.01)

(58) Field of Classification Search
CPC ... B67D 1/07; B67D 1/08; B67D 1/04; B67D 1/0835; B67D 1/0834; B67D 1/0837;
(Continued)

(56) References Cited

U.S. PATENT DOCUMENTS 5,251,787 A * 10/1993 Simson ..... B67D 1/0462 222/105
2010/0155419 A1* 6/2010 Nishino ..... B67D 1/04 222/81

(Continued)

FOREIGN PATENT DOCUMENTS

CN 87203198 A 2/1988
JP 6-047781 U 6/1994

(Continued)

OTHER PUBLICATIONS

International Search Report for PCT/KR2016/013675 dated Feb. 21, 2017 [PCT/ISA/210].

(Continued)

*Primary Examiner* — Paul R Durand
*Assistant Examiner* — Robert K Nichols, II
(74) *Attorney, Agent, or Firm* — Sughrue Mion, PLLC

(57) ABSTRACT

The present disclosure relates to a cleaning module-integrated beverage dispensing head, capable of selectively providing a cleaning function in addition to a conventional beverage dispensing function. A cleaning module-integrated beverage dispensing head includes a gas distributor (200) outputting a gas flowed in, and a pulse generator (100) receiving a supply of the gas supplied via a hose (300). The gas distributor (200) includes a first gas outlet (220) discharging the gas to the pulse generator (100), a second gas outlet (230) discharging the gas to a container (C) for storing liquid, an internal structure (200*a*) that is rotatable, and an external structure (200*b*) that is coupled to the internal structure (200*a*), to control rotation of the internal structure (200*a*). Whether or not to supply the gas to the pulse generator (100) through the first gas outlet (220) is determined according to whether or not the internal structure (200*a*) rotates.

8 Claims, 6 Drawing Sheets

(58) Field of Classification Search
CPC ..... B08B 9/032; B08B 9/0326; B08B 9/0325; B08B 9/0551; B08B 9/0328; B08B 9/0321; B08B 2209/02; B08B 2209/027; B08B 2209/032
USPC ..... 222/145.1, 145.2, 145.5
See application file for complete search history.

(56) References Cited

U.S. PATENT DOCUMENTS

| | | | | |
|---|---|---|---|---|
| 2011/0204093 | A1* | 8/2011 | Lee | B67D 1/0004 222/152 |
| 2015/0284235 | A1* | 10/2015 | Blackburn | B67D 7/0255 222/1 |

FOREIGN PATENT DOCUMENTS

| | | | |
|---|---|---|---|
| JP | 9-089137 | A | 3/1997 |
| JP | 2001-233398 | A | 8/2001 |
| JP | 2012-111541 | A | 6/2012 |
| KR | 10-2003-0031417 | A | 4/2003 |
| KR | 10-2009-0111089 | A | 10/2009 |
| KR | 10-2012-0098086 | A | 9/2012 |

OTHER PUBLICATIONS

Office Action dated Mar. 19, 2019 in Chinese Application No. 201680079684.6.
Communication dated Oct. 29, 2019, issued by the Intellectual Property Office of the P.R.C. In corresponding application no. 201680079684.6.

* cited by examiner

CLEANING MODULE-INTEGRATED BEVERAGE DISPENSING HEAD

TECHNICAL FIELD

The present disclosure relates to a cleaning module-integrated beverage dispensing head. More particularly, the present disclosure relates to an integrated beverage dispensing head capable of selectively providing a cleaning function in addition to a conventional beverage dispensing function.

BACKGROUND

Liquid supply pipes widely used in industrial equipment such as pipeline of a ship, piping of waste water sludge treatment facility, internal piping of construction plant equipment, beverage supply pipe in food and beverage equipment for the likes of beer, etc. are subject to the characteristics of internal liquid and environmental factors of the installation site, resulting in the inner walls being deposited with accumulation of foreign substances such as scales and bacteria, etc.

Specifically, when various liquid foods and beverages flow along the conduit for a long time, corrosion occurs on the inner surface of the conduit. Corrosion results when metal chemically or electrochemically reacts in contact with surrounding liquids or gases. Also, other definitions of corrosion can be expressed as follows.

a) To have a change in the conduit carrying water by external physical influences.

b) To have a certain substance approached by a chemically unstable substance which causes an electrical change, resulting in a chemical change at the approached region.

c) To render every substance with its very own electric potential to generate, when approached by a certain substance with a different electric potential, a magnetic reaction to produce foreign substances.

d) To have a certain substance, acted upon by oxygen, make changes (oxidation)

On the other hand, expressed comprehensively, corrosion can be defined as a phenomenon in which material deteriorates depending on environment.

On the inner surface of the conduit, a slime that is so-called water scale is deposited. In this way, the slime deposited on the inner surface of the conduit not only spoils the taste of the drinking liquid but also serves as a residence for bacteria to grow and contaminate the liquid.

Specifically, in ordinary water pipes and the like, slime occurs in the shape of scale deposited due to the corrosion inside the conduit, while the conduit for dispensing foods and beverages and other conduits are deposited with scale in the shape of another slime formation.

Korean Patent No. 10-0588047 shows a prior attempt to remove slime such as scale by injecting a slime removing agent or high-pressure cleaning water into the conduit.

However, the slime removal method according to the prior art not only has a low slime removal efficiency, but also dooms the human body to adverse health consequence due to the components of chemical agent when used for removing the slime, which also lead to environmental pollution issues.

Meanwhile, draft beer is generally provided to consumers in a glass from a completely sealed keg by operating a cock valve of a dispense unit with a conduit or tubing that connects to the keg.

Techniques for connecting a draft beer keg with a dispense unit or the a dispense unit itself are disclosed in patent documents including Korean Patent No. 10-0557418 and Korean Patent No. 10-0557424.

However, in the process of being discharged at a dispense unit through the tubing from the keg, the so-called "beer stone," which is settled on the inside surface of the tubing or beer dispensing system, deteriorates beer, degrades its taste and causes contamination thereof.

In the past, efforts were made to inject solutions, which, however, not only suffer from declined efficiency of beer stone removal but also hardly serve as beer stone removers for human consumption.

At the same time, although the draft beer supply line including the conduit for connection between the keg and the dispense unit, and the internal structure of the dispense unit are particularly in need of regular disinfection and cleaning management for hygiene control, there has been no method suggested for managed regular cleaning of the internal structure of such draft beer dispense equipment.

In addition, there are difficulties that those products and methods suggested to solve the above-mentioned deficiencies prescribe the user to perform cleaning by following a proprietary process that the user is not accustomed to.

In addition, the conventional beverage dispensing head lacks a cleaning function, requiring manual cleaning of interior walls of the beer dispensing head and tubing with separate cleaning instruments, which is highly troublesome and costly due to the labor with cleaning tools and equipment.

Further, when the conventional cleaning apparatus performs cleaning of the tubing by separate cleaning instruments, it attempts to increase the efficiency of cleaning by utilizing a motor or a separate large chamber of chemical supply, which adds to the number of pieces of equipment and the run time.

Therefore, there is a demand for a solution to these deficiencies.

PRIOR ART DOCUMENT

Patent Document (Patent Document 1) Korean Intellectual Property Office registered patent No. 10-0557418

(Patent Document 2) Korean Intellectual Property Office registered patent No. 10-0557424

DISCLOSURE

Technical Problem

The present disclosure in some embodiments seeks to provide a user with an integrated beverage dispensing head capable of optionally providing a cleaning function in addition to conventional beverage dispensing functions.

Technical problems are not limited to the aforementioned issues, but other unmentioned technical problems to be solved by the present disclosure can be clearly understood by one of the ordinary skilled in the art.

SUMMARY

In accordance with some embodiments of the present disclosure, a cleaning module-integrated beverage dispensing head includes a gas distributor (200) configured to output a gas flowed in, and a pulse generator (100) configured to receive a supply of the gas supplied via a hose (300). The gas distributor (200) includes a first gas outlet (220)

configured to discharge the gas to the pulse generator (100), a second gas outlet (230) configured to discharge the gas to a container (C) for storing liquid, an internal structure (200*a*) configured to be rotatable, and an external structure (200*b*) configured to be coupled to the internal structure (200*a*), and to control rotation of the internal structure (200*a*). Wherein whether or not to supply the gas to the pulse generator (100) through the first gas outlet (220) is determined according to whether or not the internal structure (200*a*) rotates.

The internal structure (200*a*) may have a predetermined circumferential portion hollowed out to include a rotation support groove (250*a*). The external structure (200*b*) may include a stopper (250*b*) configured to be movably inserted in the rotation support groove (250*a*), to thereby rotate the internal structure (200*a*), and an adjustment lever (240) configured to rotate the internal structure (200*a*) through the stopper (250*b*). The internal structure (200*a*) may be configured to be rotatable within an angular range equivalent to the rotation support groove (250*a*) over the predetermined circumferential portion.

The external structure (200*b*) may include a discharge hole (280*b*) configured to assist discharge of the gas to the first gas outlet (220). The internal structure (200*a*) may include a gas discharge-preventing groove (280*a*) formed as a recess corresponding to the discharge hole (280*b*). The discharge hole (280*b*) and the gas discharge-preventing groove (280*a*) may be configured to have a blocking member (290) interposed therebetween. When the discharge hole (280*b*), the gas discharge-preventing groove (280*a*) and the blocking member (290) that is interposed are positioned in alignment with each other, the blocking member (290) may cause to prevent the gas from passing the first gas outlet (220) towards the pulse generator (100).

When the internal structure (200*a*) is rotated through the adjustment lever (240) by the angular range equivalent to the predetermined circumferential portion, the discharge hole (280*b*), the gas discharge-preventing groove (280*a*) and the blocking member (290) that is interposed may be positioned out of alignment with each other, to disable the blocking member (290) from blocking the discharge hole (280*b*) and to thereby allow the gas to pass the first gas outlet (220) and proceed as an inflowing gas to the pulse generator (100).

The gas discharged to the second gas outlet (230) may pressurize the liquid stored in the container (C) so that the liquid is output via a piping (400), and the liquid output via the piping (400) may be supplied to the pulse generator (100), and the liquid flowing into the pulse generator (100) may be mixed with the inflowing gas, and discharged involving a surging.

When the discharge hole (280*b*), the gas discharge-preventing groove (280*a*) and the blocking member (290) that is interposed are positioned in alignment with each other, the liquid may be at least one of alcoholic beverages or food and beverage, whereas when the discharge hole (280*b*), the gas discharge-preventing groove (280*a*) and the blocking member (290) that is interposed are positioned out of alignment with each other, the liquid may be cleaning water.

The external structure (200*b*) may include a gas discharge groove (270) configured to assist discharge of the gas to the second gas outlet (230). The internal structure (200*a*) may have a predetermined circumferential portion hollowed out to provide a gas discharge support groove (260) corresponding to the gas discharge groove (270). When the gas discharge groove (270) and the gas discharge support groove (260) are positioned in alignment with each other, the gas may be discharged to the second gas outlet (230).

The gas discharged to the second gas outlet (230) may pressurize the liquid stored in the container (C) so that the liquid is output via the piping (400).

When the internal structure (200*a*) is rotated through the adjustment lever (240) by an angular range equivalent to the predetermined circumferential portion, the gas discharge groove (270) and the gas discharge support groove (260) may be positioned out of alignment with each other, to discharge the gas to the second gas outlet (230) less than when the gas discharge groove (270) and the gas discharge support groove (260) are positioned in alignment with each other.

Advantageous Effects

According to some embodiments of the present disclosure, slime, e.g. scales generated in various industrial conduits through which liquid flows, and bacteria deposits on various tubes and the like can be effectively removed by providing a user with an integrated beverage dispensing head capable of selectively providing a cleaning function in addition to conventional beverage dispensing functions.

Further, according to some embodiments of the present disclosure, water accompanied by pulsation phenomenon or surging can be used for providing sterilization and washing management over a draft beer dispense unit and the conduits thereof.

Further, according to some embodiments of the present disclosure, by utilizing a cleaning water container, one-touch selection of a cleaning mode provides vibration and pulses for cleaning the supply piping more efficiently than the conventional method.

The effects obtained by the present disclosure are not limited to those mentioned above, and other unmentioned effects will be clearly understood by one of the ordinary skilled in the art from the following description.

DETAILED DESCRIPTION

Figure 1:
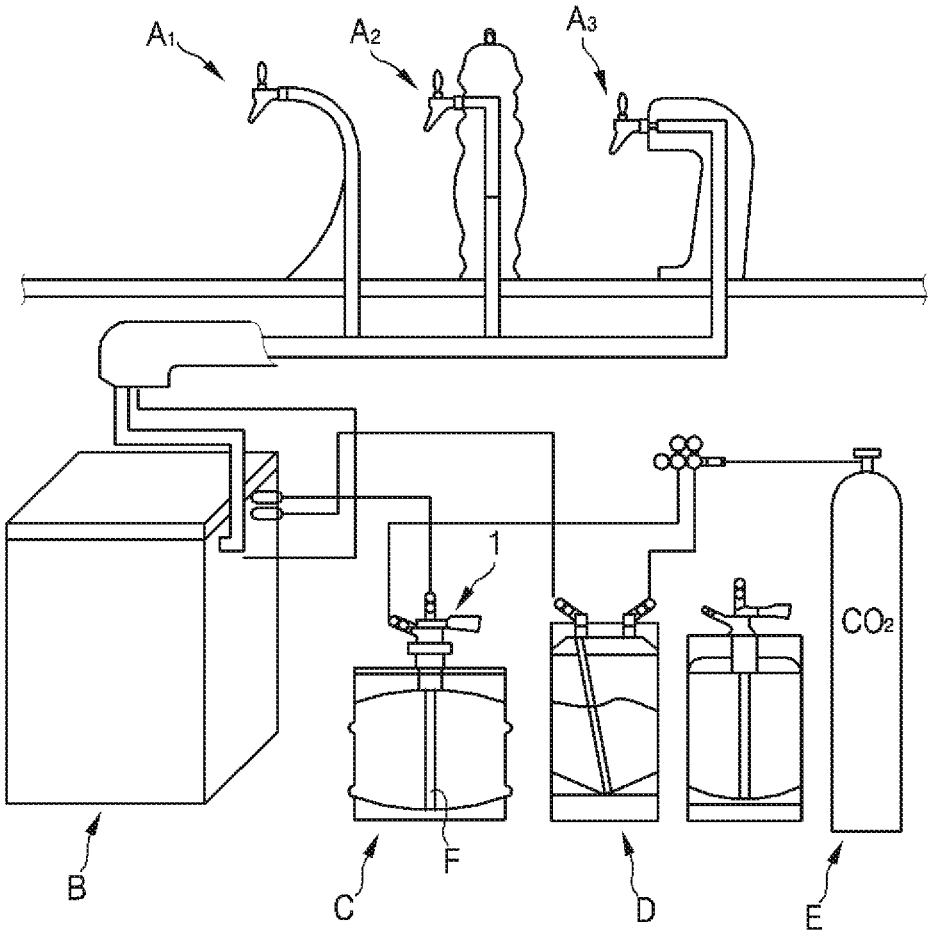
FIG. 1 is a diagram of an illustrative example of a beverage dispensing apparatus related to the present disclosure.

FIG. 1 is a diagram of an illustrative example of a beverage dispensing apparatus related to the present disclosure.

Conventional beverage dispensing system such as that illustrated in FIG. 1 may include dispensing faucets A1, A2 and A3 for different types of beverages, such as beer and carbonated beverage.

The supply of beer, cold drinks and syrup to a cooler or a carbonated water blender B may be carried out as follows.

Referring to FIG. 1, a conventional beverage dispensing apparatus includes a beer container C, one or more syrup containers D, which are shown as connected to a container C.

In addition, the beer container C and the one or more syrup containers D are connected to a source of pressurized carbon dioxide, that is, a cylindrical container or cylinder E.

At this time, the carbon dioxide is introduced in the beer container C and the syrup container D above their liquid surfaces.

The liquid is then pressurized so that it flows out through a liquid discharge module structure (siphon pipe F) that is disposed within the interior portion of the containers.

The discharge module structure F within the beer container C transfers the liquid upwards, and the liquid is discharged from the beer container C when the liquid surface is pressurized by a gas that is supplied to the inside of the beer container C by a pressurized carbon dioxide source E.

For the purpose of cleaning the interior walls of a beer dispensing head 1 and tubing, the beer container C may be used as a storage for cleaning water.

As with beer described above, the cleaning water now stored in the container C enters the installed discharge module structure F at the bottom inlet thereof, and travels therethrough with the cleaning water surface being pressurized by the gas supplied to the inside of the container C by the pressurized carbon dioxide source E, until it is discharged from the beer container C and supplied to perform cleaning of the interior walls of the beer dispensing head and tubing.

However, the conventional beverage dispensing head 1 lacks a cleaning function, requiring manual cleaning of the interior walls of the beer dispensing head and tubing with separate cleaning instruments, which is highly troublesome and costly due to the labor with cleaning tools and equipment.

In addition to utilizing separate cleaning instruments, to clean the interior walls of the beer dispensing head and tubing, the conventional cleaning apparatus employs a motor or a large chamber of chemical supply as a means for increasing the cleaning efficiency. However, these methods have deficiencies of undesirably involving additional equipment and requiring a significant amount of time.

They actually have deficiencies.

Thus, the present disclosure aims to provide an integrated beverage dispensing head capable of selectively providing a cleaning function, in addition to existing beverage dispensing capabilities.

Figure 2:
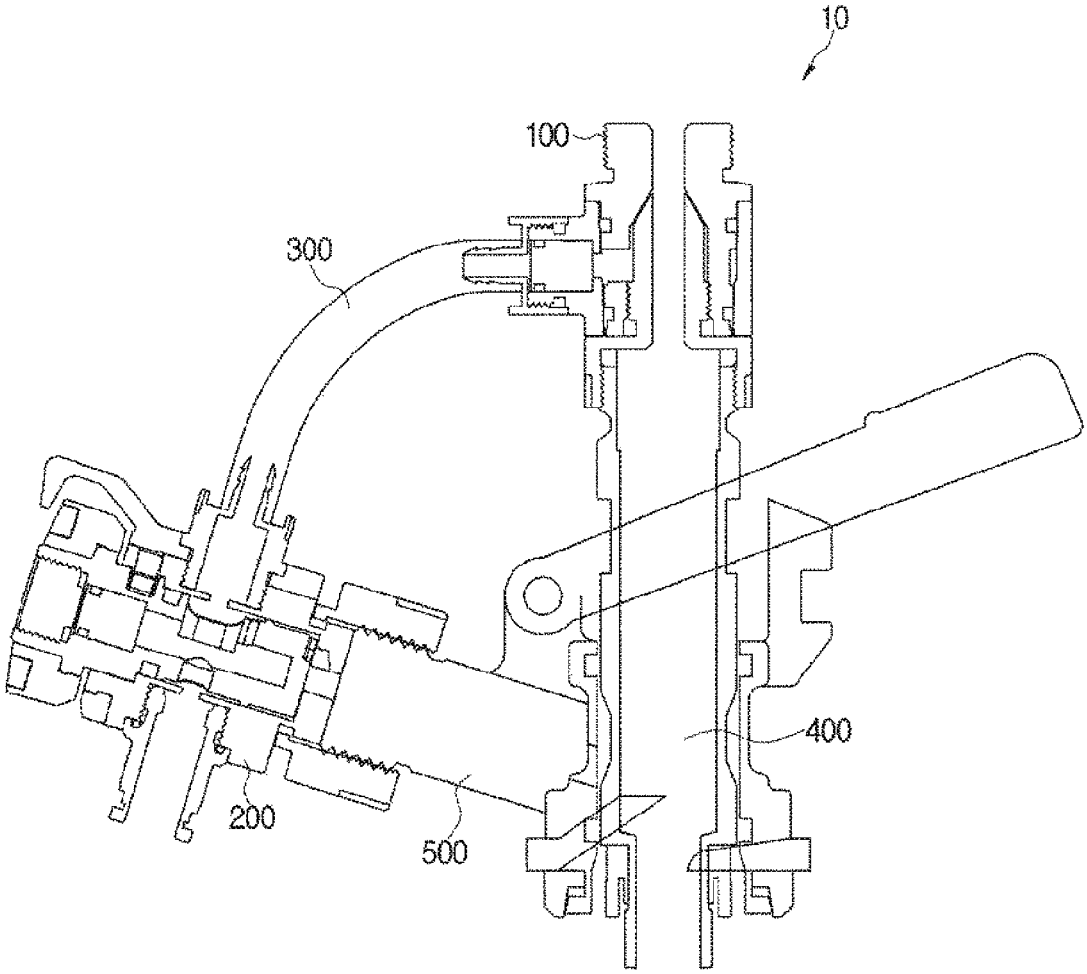
FIG. 2 is a diagram of an example cleaning module-integrated beverage dispensing head provided by some embodiments of the present disclosure.

FIG. 2 is a diagram of an example cleaning module-integrated beverage dispensing head provided by some embodiments of the present disclosure.

The cleaning module-integrated beverage dispensing head 10 illustrated in FIG. 2 may include a pulse generator 100, a gas distributor 200 and a hose 300.

The pulse generator 100 of the cleaning module-integrated beverage dispensing head 10 is connected to the end of a piping 400.

In addition, the gas distributor 200 of the integrated beverage dispensing head 10 is structured to be connected to a gas inlet 500 for supplying gas to the container C.

The gas flowing into the gas inlet 500 is arranged to proceed into the container C to pressurize the liquid in the container C, which then flows along the piping 400 to the outside.

Before a detailed description of the operation of the present disclosure, the structure of each component of the integrated beverage dispensing head 10 provided by the present disclosure will be described.

First of all, the pulse generator 100 is supplied with cleaning water vertically rising along the piping 400 and gas supplied via the hose 300 from the gas distributor 200 at the same time, which causes the cleaning water to be accompanied with a surging while it outflows through the piping, to perform the cleaning of the interior walls of the dispensing head and piping.

As used herein, the term "surging" refers to a phenomenon in which the pressure and the discharge amount of a flow of a liquid having no free surface periodically fluctuate in the piping, which generates periodic oscillation or vibration in the dispensing head and piping.

Among different causes of such surging, it is known that surging occurs when the piping's discharge conduit is long and an air pocket or a section with stagnant air exists in the piping.

Surging is a factor that impedes the smooth flow of the fluid in the pipe. In general, while studies have been conducted to prevent the surging by removing air from the piping or by adjusting the pipe's cross-sectional area, the flow velocity, and the flow rate, the present disclosure pioneers the use of surging for washing and cleaning the interior walls of the dispensing head and piping by taking advantage of the vibration in the pipe generated by the surging and the amount of energy thereby applied to the inner wall of the pipe.

This will be described in more detail with reference to FIG. 3.

Figure 3:
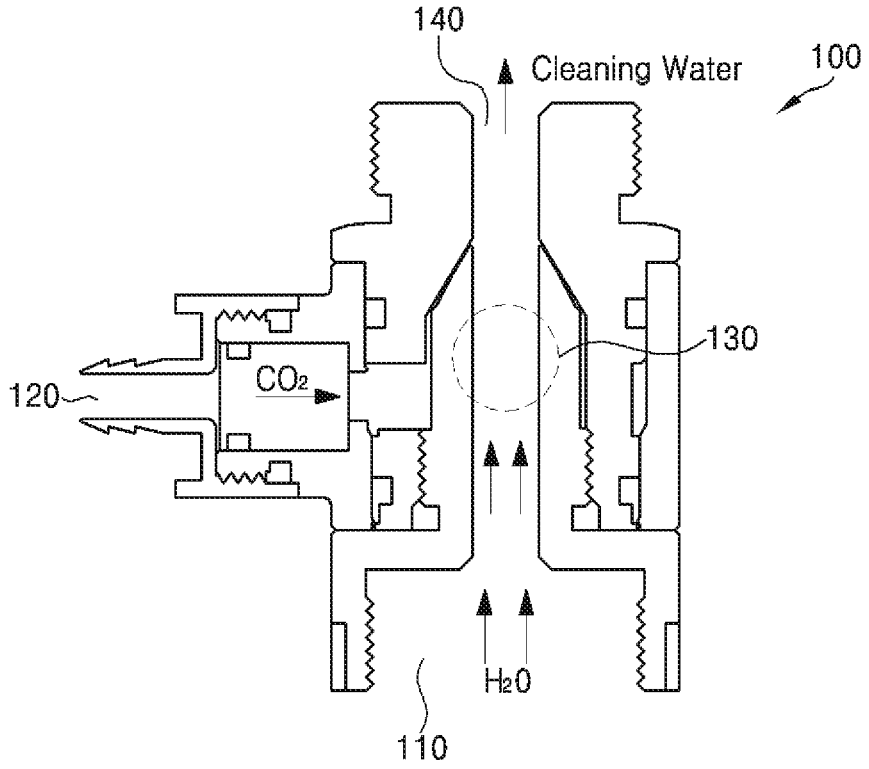
FIG. 3 is a diagram of an illustrative example pulse generator applicable to the cleaning module-integrated beverage dispensing head illustrated in FIG. 2.

FIG. 3 is a diagram of an illustrative example pulse generator applicable to the cleaning module-integrated beverage dispensing head illustrated in FIG. 2.

As shown in FIG. 3, a pulse generator 100 according to at least one embodiment of the present disclosure includes a first inlet 110, a second inlet 120, a mixing orifice 130 and an outlet 140.

At the first inlet 110, a supply of liquid such as water flows in from an external supply pipe or the container C fastened to the first inlet 110. Once the liquid flows through the first inlet 110 into the pulse generator 100, it is mixed in the mixing orifice 130 with a gas such as carbon dioxide or nitrogen gas flowing from the second inlet 120.

Meanwhile, the liquid mixed with the gas in the mixing orifice 130 is supplied via the outlet 140 to a discharge pipe (not shown) connected to the outlet 140. The gas-liquid mixture, which is discharged as cleaning water to the outside via the outlet 140, washes and cleans the inside of various industrial pipes connected to the discharge pipe.

The industrial pipes, which can be washed and cleaned with the cleaning water discharged through the pulse generator 100 according to the present disclosure as described above, may include an oil pipeline of a ship, piping of a wastewater sludge treatment facility, internal piping of construction plant equipment, beverage supply tubing in food and beverage (e.g. beer) equipment, etc. With the pulse generator 100 according to some embodiments of the present disclosure, foreign substances such as scales and bacteria deposited inside such various industrial pipes can be washed off.

On the other hand, the cleaning water supplied to the interior of the pipe to be cleaned via the outlet 140 of the pulse generator 100 according some embodiments, involves surging, while it is discharged into the pipe to be cleaned.

As used herein, the term "surging" refers to a phenomenon in which the pressure and the discharge amount of a flow of a liquid having no free surface periodically fluctuate in the piping, which generates periodic oscillation in the piping.

The inventor of the present disclosure has empirically found that, when liquid such as water is supplied through the first inlet 110 to the mixing orifice 130 of the shape and size as shown in FIG. 3, forcibly injecting a gas such as carbon dioxide through the second inlet 120 perpendicular to the liquid travel path causes the liquid for cleaning to assume surging, while it is discharged through the outlet 140, exiting the pulse generator 100 and entering the pipe to be cleaned.

In carrying out the present disclosure, the effect of washing and sterilizing by the cleaning water discharged through the outlet 140 is advantageously increased by providing the gas supplied to the mixing orifice 130 through the second inlet 120 as microbubbles of, for example, carbon dioxide.

With the cleaning liquid containing a fine bubble formation of gas such as carbon dioxide, the effect of washing and sterilizing can be further increased. To this end, the present disclosure may include an atomization mechanism (not shown) installed between second inlet 120 and the mixing orifice 130.

Specifically, a gas such as carbon dioxide supplied through the second inlet 120 is separated into micro-sized fine particles while passing through the atomization mechanism. The gas separated into the fine particles is mixed in the mixing orifice 130 with the liquid introduced through the first inlet 110, whereby the cleaning water discharged via the outlet 140 contains microbubbles due to the carbon dioxide gas or the like.

An experiment conducted in the process that led to the present disclosure confirmed that the microbubbles contained in the cleaning water when discharged involving the surging hardly extinguished to remain effective with the washing and sterilizing power over a relatively long conduit, as compared to when the cleaning water was discharged free of surging.

In addition, to guide the rotation of the gas supplied via the hose 300 from the gas distributor 200, the second inlet 120 may be formed as a rotation guiding pipe structure, or it may have an additional rotation guiding member.

On top of the surging, supplying the gas with the rotation serves to further shorten the pulsation cycle of the cleaning water.

The pulsation cycle can be further shortened when cleaning water is discharged in the same direction as the rotating direction of the gas.

In addition, the second inlet 120 may be structured to have one or more penetrations to effect increased gas inflow and gas rotation.

Further, the period of pulses generated by the surging can be determined by the form of the gas inflow conduit of the second inlet 120.

In particular, pulses can be generated in short cycles as the angle increases at which the gas flowing in, corresponding to the form of the gas inflow conduit.

Then, the gas distributor 200 has an internal structure and an external structure with structural features that serve to provide gas to the pulse generator 100 only in response to specific events.

The gas distributor 200 illustrated in FIG. 2 may be configured to be attachable to and detachable from the gas inlet 500, or it may be integrated with the gas inlet 500.

Even when the gas distributor 200 is manufactured integrally with the gas inlet 500, the gas distributor 200 can permit the gas to flow into the coupler only at the time of cleaning through the structural features of the internal and external structures thereof, which will be detailed below.

Figure 4:
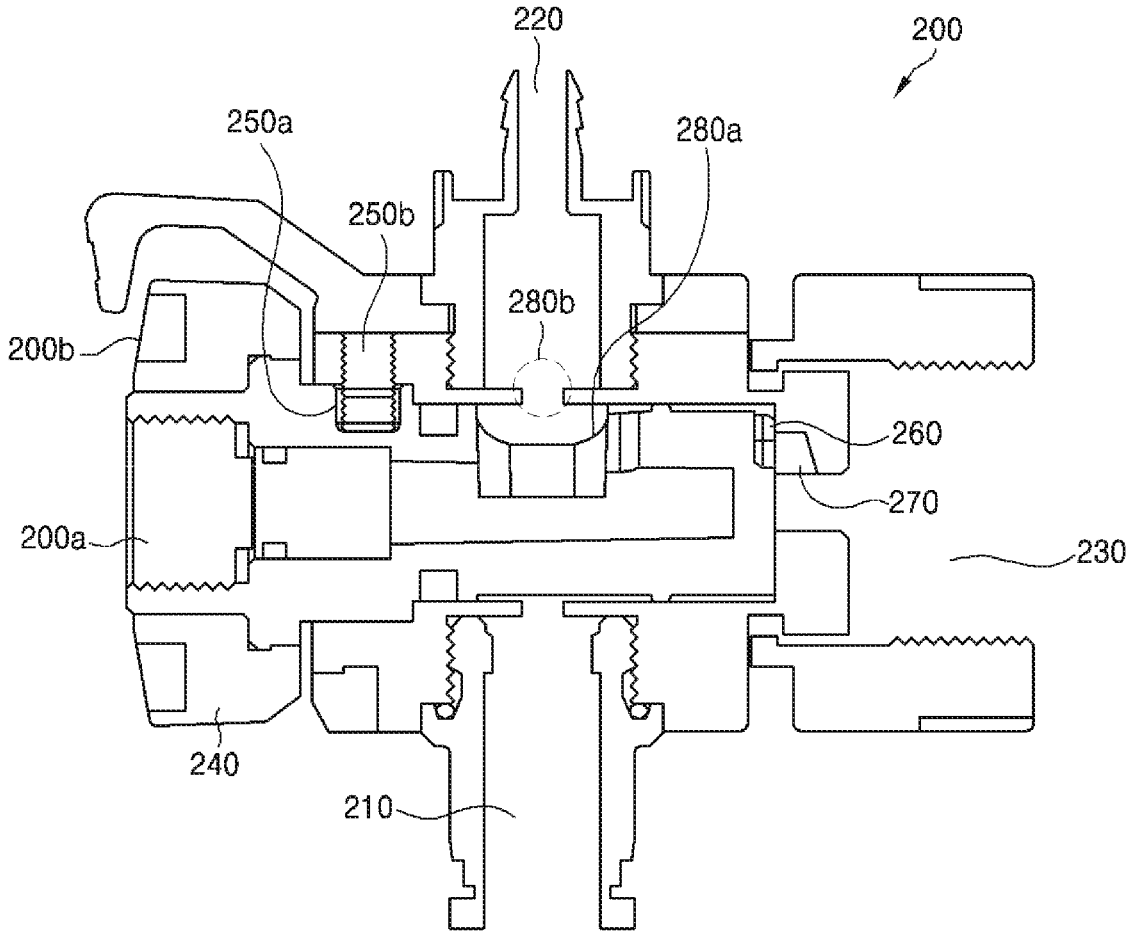
FIG. 4 is a diagram of an illustrative example of a gas distribution unit applicable to the cleaning module-integrated beverage dispensing head illustrated in FIG. 2.

FIG. 4 is a diagram of an illustrative example gas distribution unit applicable to the cleaning module-integrated beverage dispensing head illustrated in FIG. 2.

As shown in FIG. 4, the gas distributor 200 provided by at least one embodiment of the present disclosure basically includes a first gas inlet 210, a first gas outlet 220 and a second gas outlet 230. The first gas inlet 210 receives gas introduced therein. The first gas outlet 220 discharges the gas through the hose 300 into the pulse generator 100. The second gas outlet 230 is adapted to discharge the gas to the gas inlet 500 which in turn transfers the gas up to its connected container C.

Specifically, the gas distributor 200 according to at least one embodiment includes an internal structure 200*a* and an external structure 200*b*.

Here, the internal structure 200*a* is configured to be rotated by an adjustment lever 240 of the external structure 200*b*.

Further, the internal structure 200*a* has a predetermined circumferential portion hollowed out to provide a rotation support groove 250*a* corresponding to a stopper 250*b* of the external structure 200*b*.

For example, when the rotation support groove 250*a* extends along a 90-degree section of the full 360-degree circumference of the internal structure 200*a*, the stopper 250*b* movably inserted in the rotation support groove 250*a* is controlled to move within the 90-degree range, and as a result, the internal structure 200*a* and the external structure 200*b* are arranged to be rotatable up to 90-degree range based on a fixed position.

In addition, the internal structure 200*a* has a predetermined circumferential portion hollowed out to provide a gas discharge support groove 260 corresponding to a gas discharge groove 270 formed in the external structure 200*b*.

For example, the gas discharge groove 270 of the external structure 200*b* may have a circular hole shape, and the gas discharge support groove 260 may have a hole shape of the same diameter of as that of the gas discharge groove 270.

When the gas discharge groove 270 is in alignment with the gas discharge support groove 260, the gas flows to the second gas outlet 230 via the gas discharge groove 270, and it is then easily introduced into the gas inlet 500.

However, when the stopper 250*b* of the external structure 200*b* and the rotation support groove 250*a* of the internal structure 200*a* cooperate to rotate the internal structure 200*a* and the external structure 200*b* by a predetermined angle, the gas discharge groove 270 is out of alignment with the gas discharge support groove 260, to discharge the gas into the gas inlet 500 significantly less than when the gas discharge groove 270 is in alignment with the gas discharge support groove 260.

In some embodiments, the internal structure 200*a* has a gas discharge-preventing groove 280*a* formed as a recess, while the external structure 200*b* connected to the first gas outlet 220 has a discharge hole 280*b* corresponding to the gas discharge preventing groove 280*a*.

Here, the gas discharge-preventing groove 280*a* may receive a blocking member 290 implemented with rubber or the like.

As a result, the gas discharge-preventing groove 280*a* and the discharge hole 280*b* are arranged to pinch the blocking member 290 which thereby provides compression or sealing for preventing the gas from passing the discharge hole 280*b* towards the first gas outlet 220.

However, when the stopper 250*b* of the external structure 200*b* and the rotation support groove 250*a* of the internal structure 200*a* cooperate to rotate the internal structure 200*a* and the external structure 200*b* by the predetermined angle, the gas discharge-preventing groove 280*a* is out of alignment with the discharge hole 280*b*, to disable the blocking member 290 from blocking the discharge hole 280*b* and to thereby allow the gas to pass the discharge hole 280*b* and proceed to the first gas outlet 220.

In other words, the external structure 200*b* includes the adjustment lever 240, the stopper 250*b* inserted snugly in the rotation support groove 250*a* of the internal structure 200*a*, and the gas discharge groove 270.

First, the adjustment lever 240 serves as a user operable controller that, when operated by the user, enables the stopper 250*b* of the external structure 200*b* and the rotation support groove 250*a* of the internal structure 200*a* to cooperate to rotate the internal structure 200*a* and the external structure 200*b* by the predetermined angle.

Further, as described above, the stopper 250*b* rotates the internal structure 200*a* through the rotation support groove 250*a* extending along just a predetermined portion of the full 360-degree circumference of the internal structure 200*a*, and thereby limiting the internal structure 200*a* by the predetermined degree of rotation.

For example, when the rotation support groove 250*a* extends along a 90-degree section of the full 360-degree circumference of the internal structure 200*a*, the stopper 250*b* movably inserted in the rotation support groove 250*a* is controlled to move in the 90-degree range, and as a result, the internal structure 200*a* and the external structure 200*b* are arranged to be rotatable up to 90 degrees based on a fixed position.

Therefore, in this case, the user can rotate the adjustment lever 240 up to 90 degrees.

In addition, as described above, the gas discharge groove 270 is provided corresponding to the gas discharge support groove 260 formed through a predetermined area in the internal structure 200*a*.

For example, when the gas discharge groove 270 is in alignment with the gas discharge support groove 260, the gas easily flows into the gas inlet 500 through the gas discharge groove 270. However, when the stopper 250*b* of the external structure 200*b* and the rotation support groove 250*a* of the internal structure 200*a* cooperate to rotate the internal structure 200*a* and the external structure 200*b* by a predetermined angle, the gas discharge groove 270 is out of alignment with the gas discharge support groove 260, to significantly reduce the amount of gas flowing into the gas inlet 500 as compared with the case where the gas discharge groove 270 is in alignment with the gas discharge support groove 260.

Figure 5:
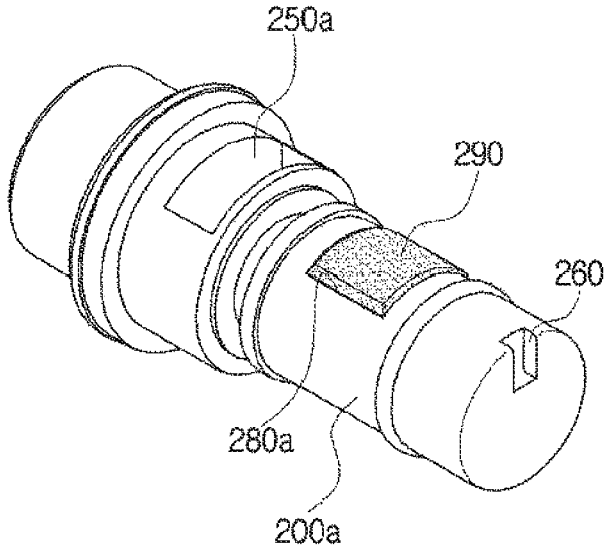
FIG. 5 is a diagram of an example internal structure applicable to a gas distribution unit of some embodiments of the present disclosure.
Figure 6:
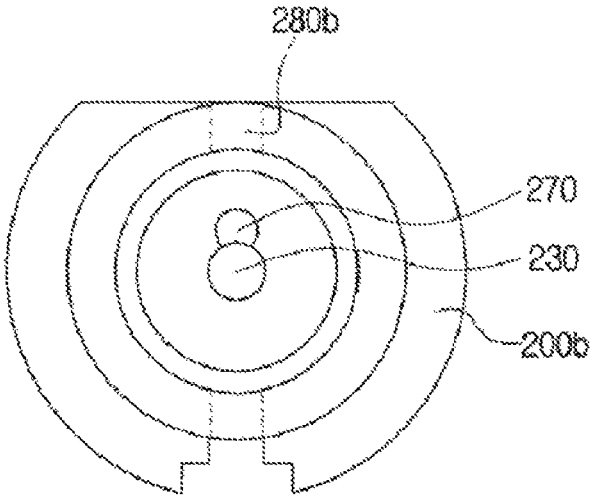
FIG. 6 is a diagram of an example external structure applicable to a gas distribution unit of some embodiments of the present disclosure.

With reference to FIGS. 5 and 6, the internal structure 200*a* and the external structure 200*b* of the gas distributor 200 of at least one embodiment of the present disclosure will be described in detail.

FIG. 5 is a diagram of an example internal structure applicable to a gas distribution unit of some embodiments of the present disclosure, and FIG. 6 is a diagram of an example external structure applicable to a gas distribution unit of some embodiments of the present disclosure.

As shown in FIG. 5, the internal structure 200*a* has a predetermined portion hollowed out to provide a rotation support groove 250*a* extending along just a predetermined portion of the full 360-degree circumference of the internal structure 200*a* corresponding to the stopper 250*b* of the external structure 200*b*.

In addition, the internal structure 200*a* has a predetermined portion hollowed out to provide a gas discharge support groove 260 corresponding to a gas discharge groove 270 formed in the external structure 200*b* of FIG. 6.

In addition, the internal structure 200*a* has a gas discharge-preventing groove 280*a* formed as a recess, while the external structure 200*b* connected to the first gas outlet 220 has a discharge hole 280*b* corresponding to the gas discharge preventing groove 280*a*.

FIG. 5 shows the gas discharge preventing groove 280*a* with the corresponding blocking member 290 being inserted therein.

In addition, as described above and shown in FIG. 6, the gas discharge groove 270 is provided corresponding to the gas discharge support groove 260 formed through a predetermined area in the internal structure 200*a*.

Referring also to FIG. 6, a discharge hole 280*b* is shown.

As described above, pinched between the gas discharge-preventing groove 280*a* and the discharge hole 280*b*, the blocking member 290 provides compression or sealing for preventing the gas from passing the discharge hole 280*b* towards the first gas outlet 220.

However, when the stopper 250*b* of the external structure 200*b* and the rotation support groove 250*a* of the internal structure 200*a* cooperate to rotate the internal structure 200*a* and the external structure 200*b* by the predetermined angle, the gas discharge-preventing groove 280*a* is out of alignment with the discharge hole 280*b*, to disable the blocking member 290 from blocking the discharge hole 280*b* and to thereby allow the gas to pass the discharge hole 280*b* and proceed to the first gas outlet 220.

Based on the configuration of some embodiments of the present disclosure described above, the following explains the cleaning module-integrated beverage dispensing head 10 as used for selectively supplying gas to the pulse generator 100 besides the beverage dispensing function thereof.

Figure 7:
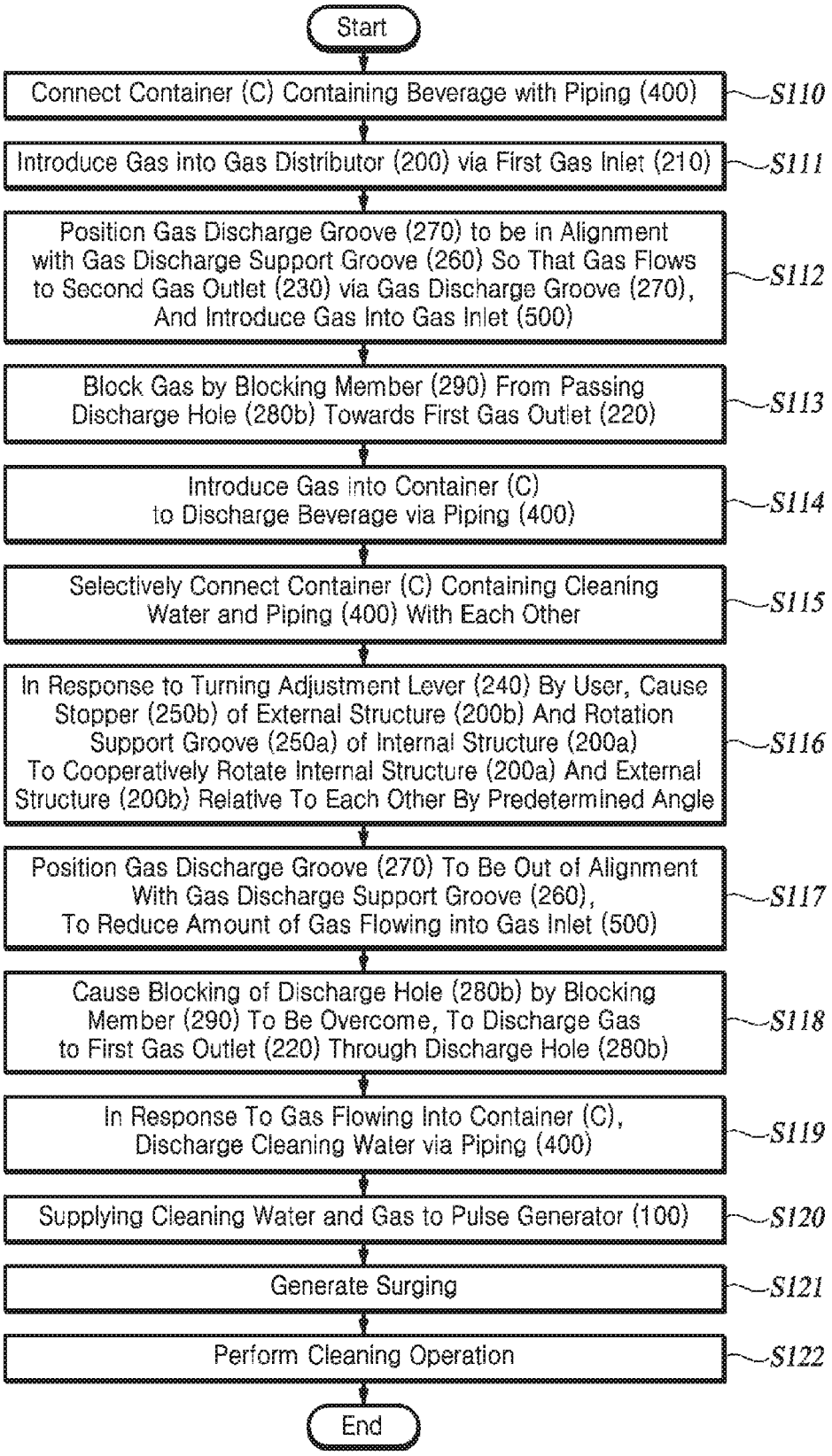
FIG. 7 is a flowchart of an illustrative procedure in which a beverage dispensing function and a cleaning function are simultaneously provided through a cleaning module-integrated beverage dispensing head provided by the present disclosure.

FIG. 7 is a flowchart of an illustrative procedure in which a beverage dispensing function and a cleaning function are simultaneously provided through a cleaning module-integrated beverage dispensing head provided by some embodiments of the present disclosure.

As shown in FIG. 7, the container C containing the beverage and the piping 400 are connected to each other in the first step (S110).

Here, the beverage may refer to beer, or food and beverage.

Thereafter, gas is introduced into the gas distributor 200 via the first gas inlet 210 (S111).

Subsequent to Step S111, the gas discharge groove 270 and the gas discharge support groove 260 are positioned in alignment with each other so that the gas flows to the second gas outlet 230 via the gas discharge groove 270, and thereby the gas is introduced into the gas inlet 500 (S112).

As described above, the internal structure 200*a* has a predetermined portion hollowed out to provide the gas discharge support groove 260 corresponding to the gas discharge groove 270 in the external structure 200*b*.

For example, the gas discharge groove 270 of the external structure 200*b* may have a circular hole shape, and the gas discharge support groove 260 may have a hole shape of the same diameter of as that of the gas discharge groove 270.

When the gas discharge groove 270 is in alignment with the gas discharge support groove 260, the gas flows to the second gas outlet 230 via the gas discharge groove 270, and it is then easily introduced into the gas inlet 500.

Thereafter, the gas is blocked by the blocking member 290 from passing the discharge hole 280*b* towards the first gas outlet 220 (S113).

Specifically, the internal structure 200*a* has the gas discharge-preventing groove 280*a* formed as a recess, while the external structure 200*b* connected to the first gas outlet 220 has the discharge hole 280*b* corresponding to the gas discharge preventing groove 280*a*. Here, the gas discharge-preventing groove 280*a* may receive the blocking member 290 implemented with rubber or the like.

As a result, the gas discharge-preventing groove 280*a* and the discharge hole 280*b* are arranged to pinch the blocking member 290 which thereby provides compression or sealing for preventing the gas from passing the discharge hole 280*b* towards the first gas outlet 220.

Thereafter, the gas is introduced into the container C, to discharge the beverage via the piping 400 (S114).

Therefore, in this case, the gas is not supplied to the pulse generator 100, but it performs as the most common beer dispensing head.

Selectively, the container C containing cleaning water and the piping 400 are connected to each other (S115).

Subsequent to Step S115, the user turns the adjustment lever 240 so that the stopper 250*b* of the external structure 200*b* and the rotation support groove 250*a* of the internal structure 200*a* cooperate to rotate the internal structure 200*a* and the external structure 200*b* by a predetermined angle (S116).

The adjustment lever 240 serves as a user operable controller that, when operated by the user, enables the stopper 250*b* of the external structure 200*b* and the rotation support groove 250*a* of the internal structure 200*a* to cooperate to rotate the internal structure 200*a* and the external structure 200*b* by the predetermined angle.

Further, as described above, the stopper 250*b* rotates the internal structure 200*a* through the rotation support groove 250*a* extending along just a predetermined portion of the full 360-degree circumference of the internal structure 200*a*, and thereby limiting the internal structure 200*a* by the predetermined degree of rotation.

For example, when the rotation support groove 250*a* extends along a 90-degree section of the full 360-degree circumference of the internal structure 200*a*, the stopper 250*b* movably inserted in the rotation support groove 250*a* is controlled to move in the 90-degree range, and as a result, the internal structure 200*a* and the external structure 200*b* are arranged to be rotatable up to 90 degrees based on a fixed position.

Therefore, in this case, the user can rotate the adjustment lever 240 up to 90 degrees.

In accordance with the rotation of the adjustment lever 240, the gas discharge groove 270 is out of alignment with the gas discharge support groove 260, to reduce the amount of gas flowing into the gas inlet 500 (S117).

As compared with when the two grooves are in alignment with each other, the amount of gas flowing into the gas inlet 500 is considerably reduced.

However, although the amount of gas flowing into the gas inlet 500 decreases, the gas continues to enter the gas inlet 500.

In addition, Step S117 causes the amount of gas discharged to the first gas outlet 220 to exceed the amount of gas flowing into the gas inlet 500 in the next Step S118.

As a result, the blocking of the discharge hole 280*b* by the blocking member 290 is overcome to discharge the gas to the first gas outlet 220 through the discharge hole 280*b* (S118).

Further, in response to Step S117 causing the gas to flow into the container C, the cleaning water is discharged via the piping 400 (S119).

This leads to supplying the cleaning water and the gas to the pulse generator 100 (S120), and finally the generation of surging (S121).

As described above, surging refers to a phenomenon in which the pressure and the discharge amount of a flow of a liquid having no free surface periodically fluctuate in the piping, which generates periodic vibration in the piping.

In other words, where liquid such as water is supplied through the first inlet 110 to the mixing orifice 130 of the shape and size as shown in FIG. 3, forcibly injecting a gas such as carbon dioxide through the second inlet 120 perpendicular to the liquid travel path causes the cleaning water to assume surging, while it is discharged through the outlet 140, exiting the pulse generator 100 and entering the pipe to be cleaned.

Therefore, the surging assists to perform the cleaning operation (S122).

With the aforementioned configuration of at least one embodiment of the present disclosure, slime, e.g. scales generated in various industrial conduits through which liquid flows, and bacteria deposits on various tubes and the like can be effectively removed by providing the user with an integrated beverage dispensing head capable of selectively providing a cleaning function in addition to conventional beverage dispensing functions.

Further, according to some embodiments of the present disclosure, water accompanied by pulsation phenomenon or surging can be used for providing sterilization and washing management over a draft beer dispense unit and the conduits thereof.

Further, according to some embodiments of the present disclosure, by utilizing a cleaning water container, one-touch selection of a cleaning mode provides vibration and pulses for cleaning the supply piping more efficiently than the conventional method.

As noted above, the detailed description of the disclosed embodiments of the present disclosure has been provided so that those skilled in the art can implement and practice the embodiments. While the disclosure has been described with reference to the illustrative embodiments thereof, those skilled in the art will appreciate that various modifications and changes can be made to the disclosure without departing from the scope of the disclosure. For example, those skilled in the art can use each of the configurations described in the above embodiments in combination with each other. Accordingly, the disclosure is not intended to be limited to the embodiments shown herein, but is to be accorded the scope of the appended claims in accordance with the principles and novel features disclosed herein.

The present disclosure can be embodied in other specific forms without departing from the idea and essential features. Accordingly, the above detailed description should not be construed restrictively in all aspects and should be regarded as illustrative. The scope of the disclosure should be determined by a reasonable interpretation of the appended claims, and all changes within the equivalent scope of the disclosure are within the scope of the disclosure. The present disclosure is not intended to be limited to the embodiments shown herein, but is to be accorded the scope of the appended claims consistent with the principles and novel features disclosed herein. In addition, the present disclosure encompasses combination of the appended claims that do not have explicit interdependencies to establish embodiments, or future submission of amendments to incorporate new claims.

CROSS-REFERENCE TO RELATED APPLICATION

This application claims priority under 35 U.S.C § 119(a) of Patent Application No. 10-2015-0165424, filed on Nov. 25, 2015 in Korea, the entire content of which is incorporated herein by reference. In addition, this non-provisional application claims priority in countries, other than the U.S., with the same reason based on the Korean patent application, the entire content of which is hereby incorporated by reference.

The invention claimed is:

1. A cleaning module-integrated beverage dispensing head, comprising:

a gas distributor configured to output a gas received in the gas distributor; and a pulse generator configured to receive a supply of the gas supplied via a hose, wherein the pulse generator comprises:

a first inlet;

a second inlet configured to provide a gas on liquid supplied through the first inlet;

a mixing orifice;

an atomization mechanism installed between the second inlet and the mixing orifice and configured to separate the gas supplied through the second inlet with microbubbles, wherein the gas distributor comprises:

a first gas outlet configured to discharge the gas to the second inlet;

a second gas outlet configured to discharge the gas to a container for storing the liquid;

an internal structure configured to be rotatable; and an external structure configured to be coupled to the internal structure, and to control rotation of the internal structure, and wherein whether or not to supply the gas to the pulse generator through the first gas outlet is determined according to whether or not the internal structure rotates, and wherein the gas distributer is further configured to simultaneously control a flow to the first gas outlet and the second gas outlet.

2. The cleaning module-integrated beverage dispensing head of claim 1, wherein the internal structure has a predetermined circumferential portion hollowed out to include a rotation support groove, wherein the external structure comprises:

a stopper configured to be movably inserted in the rotation support groove, to thereby rotate the internal structure;

an adjustment lever configured to rotate the internal structure through the stopper, and wherein the internal structure is configured to be rotatable within an angular range equivalent to the rotation support groove over the predetermined circumferential portion.

3. The cleaning module-integrated beverage dispensing head of claim 2, wherein the external structure comprises a discharge hole configured to assist the discharge of the gas to the first gas outlet, wherein the internal structure comprises a gas discharge-preventing groove formed as a recess corresponding to the discharge hole, wherein the discharge hole and the gas discharge-preventing groove are configured to have a blocking member interposed therebetween, and wherein when the discharge hole, the gas discharge-preventing groove and the blocking member that is interposed are positioned in alignment with each other, the blocking member prevents the gas from passing the first gas outlet towards the pulse generator.

4. The cleaning module-integrated beverage dispensing head of claim 3, wherein when the internal structure is rotated through the adjustment lever by the angular range equivalent to the predetermined circumferential portion, the discharge hole, the gas discharge-preventing groove and the blocking member that is interposed are positioned out of alignment with each other, to disable the blocking member from blocking the discharge hole and to thereby allow the gas to pass the first gas outlet and proceed as an inflowing gas to the pulse generator.

5. The cleaning module-integrated beverage dispensing head of claim 4, wherein the gas discharged to the second gas outlet pressurizes the liquid stored in the container so that the liquid is output via a piping, the liquid output via the piping is supplied to the pulse generator, and the liquid flowing into the pulse generator is mixed with the inflowing gas, and is discharged involving a surging.

6. The cleaning module-integrated beverage dispensing head of claim 5, wherein when the discharge hole, the gas discharge-preventing groove and the blocking member that is interposed are positioned in alignment with each other, the liquid is at least one of alcoholic beverages or food and beverage, and wherein when the discharge hole, the gas discharge-preventing groove and the blocking member that is interposed are positioned out of alignment with each other, the liquid is cleaning water.

7. The cleaning module-integrated beverage dispensing head of claim 1, wherein the external structure comprises a gas discharge groove configured to assist the discharge of the gas to the second gas outlet, wherein the internal structure has a predetermined circumferential portion hollowed out to provide a gas discharge support groove corresponding to the gas discharge groove, and wherein when the gas discharge groove and the gas discharge support groove are positioned in alignment with each other, the gas is discharged to the second gas outlet.

8. The cleaning module-integrated beverage dispensing head of claim 7, wherein when the internal structure is rotated through the adjustment lever by an angular range equivalent to the predetermined circumferential portion, the gas discharge groove and the gas discharge support groove are positioned out of alignment with each other, to discharge the gas to the second gas outlet less than when the gas discharge groove and the gas discharge support groove are positioned in alignment with each other.

* * * * *